US009464798B2

(12) United States Patent
Higgs

(10) Patent No.: US 9,464,798 B2
(45) Date of Patent: Oct. 11, 2016

(54) HOUSEHOLD LAMP SWITCH EXTENSION APPARATUS

(71) Applicant: James Higgs, Cayse, SC (US)

(72) Inventor: James Higgs, Cayse, SC (US)

( * ) Notice: Subject to any disclaimer, the term of this patent is extended or adjusted under 35 U.S.C. 154(b) by 0 days.

(21) Appl. No.: 14/254,569

(22) Filed: Apr. 16, 2014

(65) Prior Publication Data

US 2015/0300615 A1 Oct. 22, 2015

(51) Int. Cl.

| | |
|---|---|
| ***F21V 23/04*** | (2006.01) |
| ***F21S 6/00*** | (2006.01) |
| ***F21V 17/08*** | (2006.01) |
| ***F21V 17/10*** | (2006.01) |

(52) U.S. Cl.

CPC ..... *F21V 23/04* (2013.01); *F21S 6/00* (2013.01); *F21V 17/08* (2013.01); *F21V 17/10* (2013.01)

(58) Field of Classification Search

CPC ..... F21V 23/04; F21V 17/08; F21V 17/10; F21S 6/00

See application file for complete search history.

(56) References Cited

U.S. PATENT DOCUMENTS

| | | | | |
|---|---|---|---|---|
| 1,812,290 | A * | 6/1931 | Gehersky | B60Q 1/245 362/424 |
| 2,014,217 | A * | 9/1935 | Williamson | F21V 23/04 200/330 |
| 2,414,807 | A * | 1/1947 | Gross | F41G 1/35 340/815.77 |
| 2,598,310 | A * | 5/1952 | Schaser | F21V 21/26 200/331 |
| 2,674,689 | A * | 4/1954 | Thornton | F21V 23/04 362/249.12 |
| 2,785,243 | A * | 3/1957 | Benander | F21V 23/04 200/335 |
| 4,274,129 | A * | 6/1981 | Stevens | F21V 33/00 362/109 |
| 6,423,919 | B1 * | 7/2002 | Liao | F21V 21/40 200/330 |
| 6,621,026 | B1 * | 9/2003 | Wei | H01H 17/08 200/330 |
| 6,768,072 | B1 * | 7/2004 | Yang | H01H 13/58 200/320 |
| 7,345,251 | B2 * | 3/2008 | Leddusire | H01H 3/04 200/331 |

* cited by examiner

*Primary Examiner* — Mary Ellen Bowman

(57) ABSTRACT

The invention is a household lamp switch extension apparatus that makes it easy for a user to reach across the top of the lamp shade to turn on the lamp. This keeps the user from having to bend over and awkwardly look for or blindly grope for the lamp switch that to the typical user appears hidden within the lamp shade. Various embodiments of the apparatus can work with standard on and off switches that operate by rotation of a knob, by pulling a chain, or by pushing a small button. The apparatus has a vertical member that extends a twist knob to a position at or near the top of the typical lamp shade and that connects to a horizontal member that interacts with the on and off switch for the lamp.

14 Claims, 9 Drawing Sheets

HOUSEHOLD LAMP SWITCH EXTENSION APPARATUS

RELATED APPLICATIONS

Applicant claims the benefit of prior filed, pending U.S. Provisional Application 61/812,317.

FEDERALLY SPONSORED RESEARCH OR DEVELOPMENT

Not applicable.

REFERENCED OR INCORPORATED MATERIAL

Not applicable.

BACKGROUND OF INVENTION

The present invention relates to an apparatus that improves the usefulness of a household lamp on and off switch. The apparatus primarily achieves this improvement in function through an add-on extension that is more readily visible than a typical lamp switch and that makes the typical lamp switch more easily accessible.

The various switch mechanisms for the standard household lamp are quite old art. Generally speaking, they consist of knobs for turning a lamp on and off by means of a twist motion, buttons for turning a lamp on and off by means of a push motion, or chains or similar hanging materials for turning a lamp on and off by means of a pulling motion. A standard household lamp typically positioned as table model or as a floor standing model has a lamp shade that usually or almost always blocks visual access to the on and off switch mechanism. To use the switch typically requires that the user bend down and look or blindly grope under the lampshade to find the switch that is to be twisted, pushed or pulled.

There are numerous types of devices for extending access to items. An example would be the extender that can be used with a socket wrench to insert the socket into a tight space where normal hand usage would be impossible.

Thus, basic on and off switches for household lamps and extension devices of many types have separately coexisted for many years, and yet, no prior art exists that encompasses or even suggests the present invention.

SUMMARY OF THE INVENTION

The present invention relates to an extension apparatus that is positioned at or near the top of a lamp shade and that is thereby more visible to a typical user. Being more visible and located near the top of the lamp shade also makes the extended on and off switch more accessible. The lamp switch extender does not eliminate the standard option to turn the lamp on and off at its original knob location.

It is an object of the present invention to respond to a long felt need in the art of on and off switches for household lamps to make them more user friendly when positioned at a relatively low position or when used by a relatively tall user. The present invention recognizes this need by making it easier for said user to see the extended on and off switch positioned inside the lamp shade and at or near the top of the lamp shade. Such a user will no longer have to blindly grope for or bend over to find and use the on and off switch. This can be especially beneficial for an elderly user.

Another aspect of the present invention which relates to its utility is its ability to work with several different types of on and off switches.

DETAILED DESCRIPTION

Figure 1:
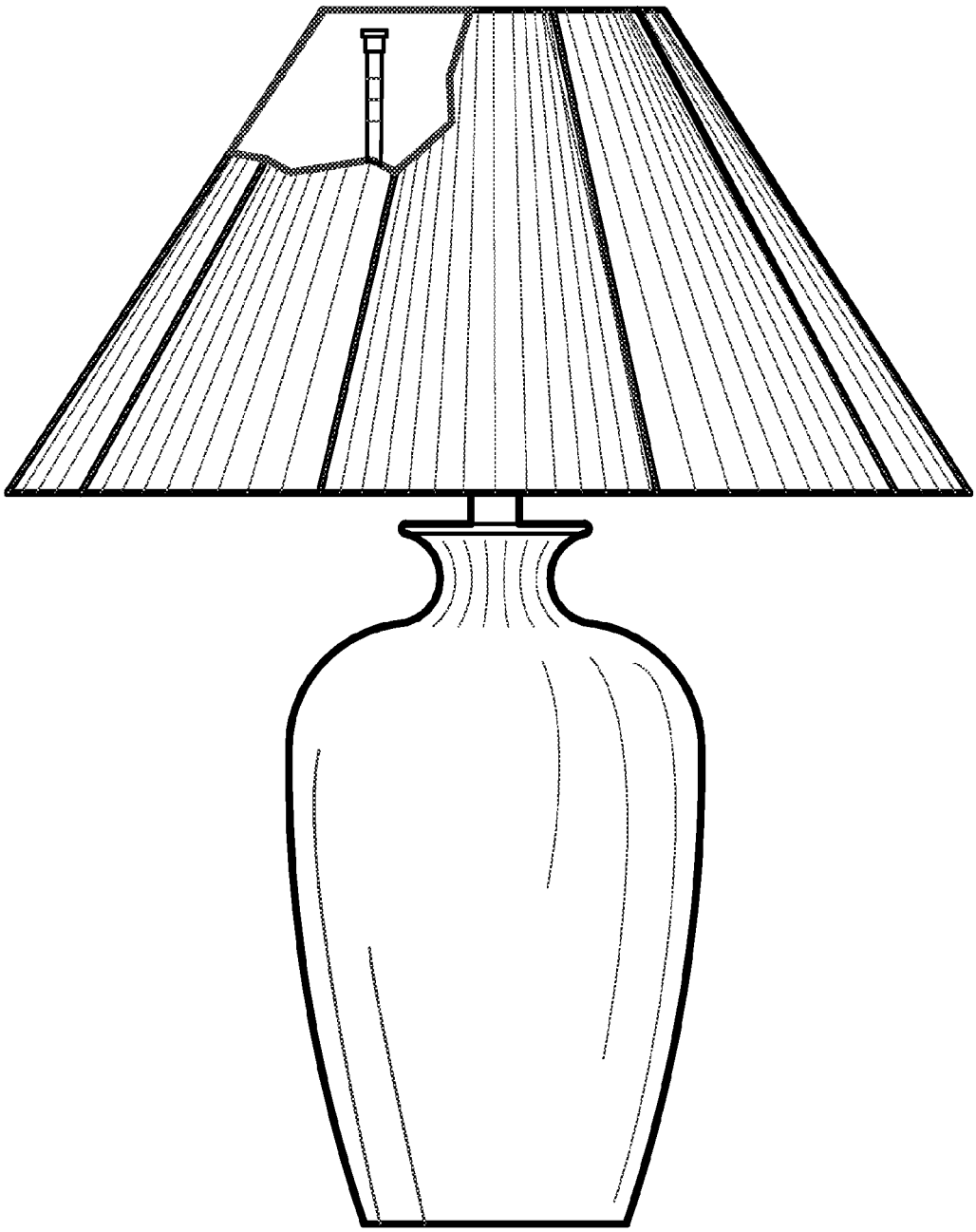
FIG. 1 is a side view of a lamp and lamp shade with a partial cut-away showing the top of the apparatus positioned inside the lamp shade.
Figure 2:
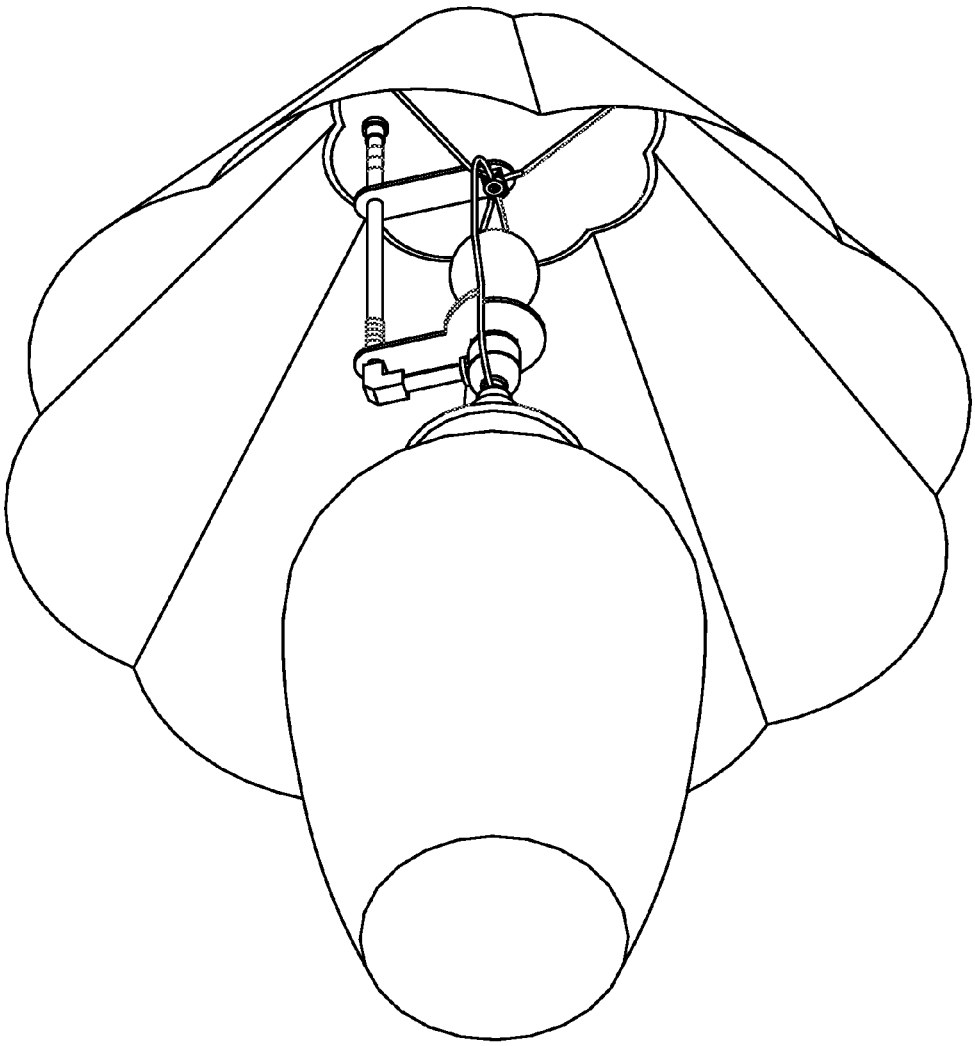
FIG. 2 is angled view from beneath the lamp and lamp shade showing an embodiment of the extension apparatus installed on the lamp socket and harp.
Figure 3:
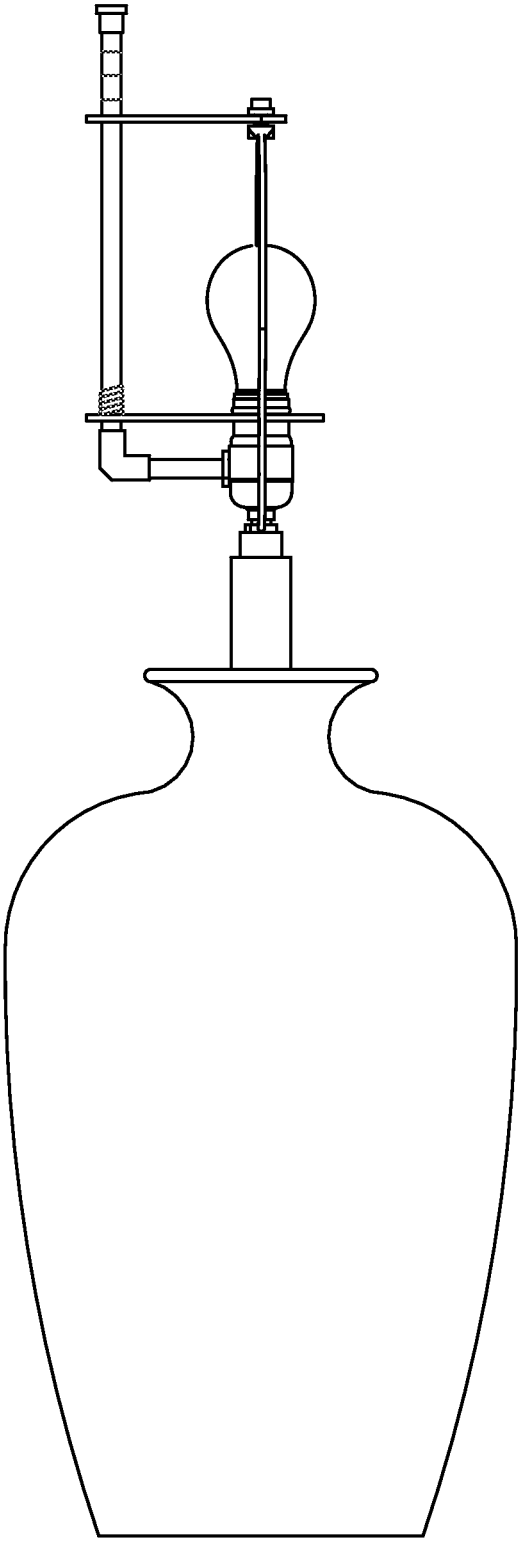
FIG. 3 is a side view of the lamp and the apparatus without the lamp shade.
Figure 4:
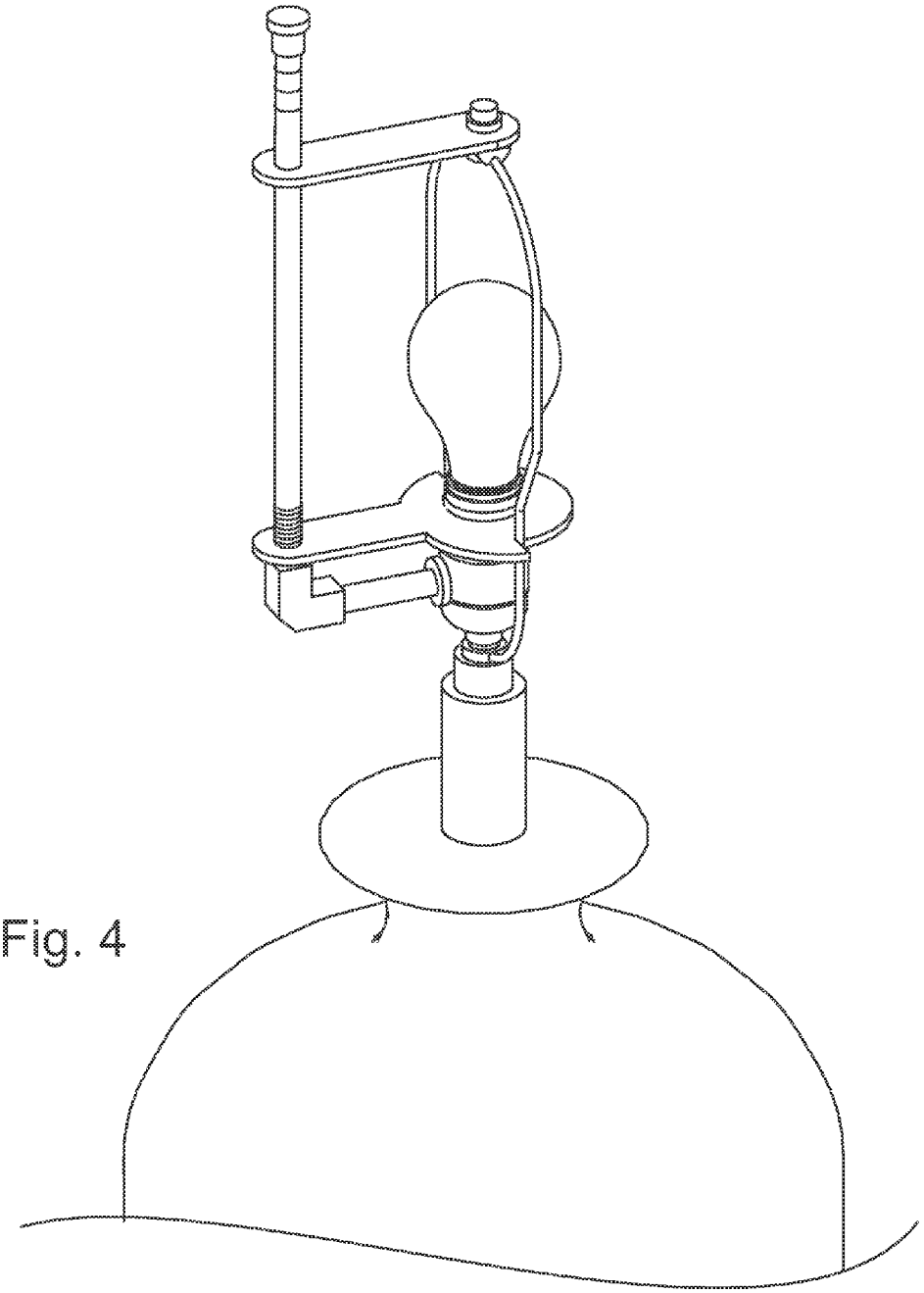
FIG. 4 is a perspective view of the lamp and the apparatus without the lamp shade.
Figure 5:
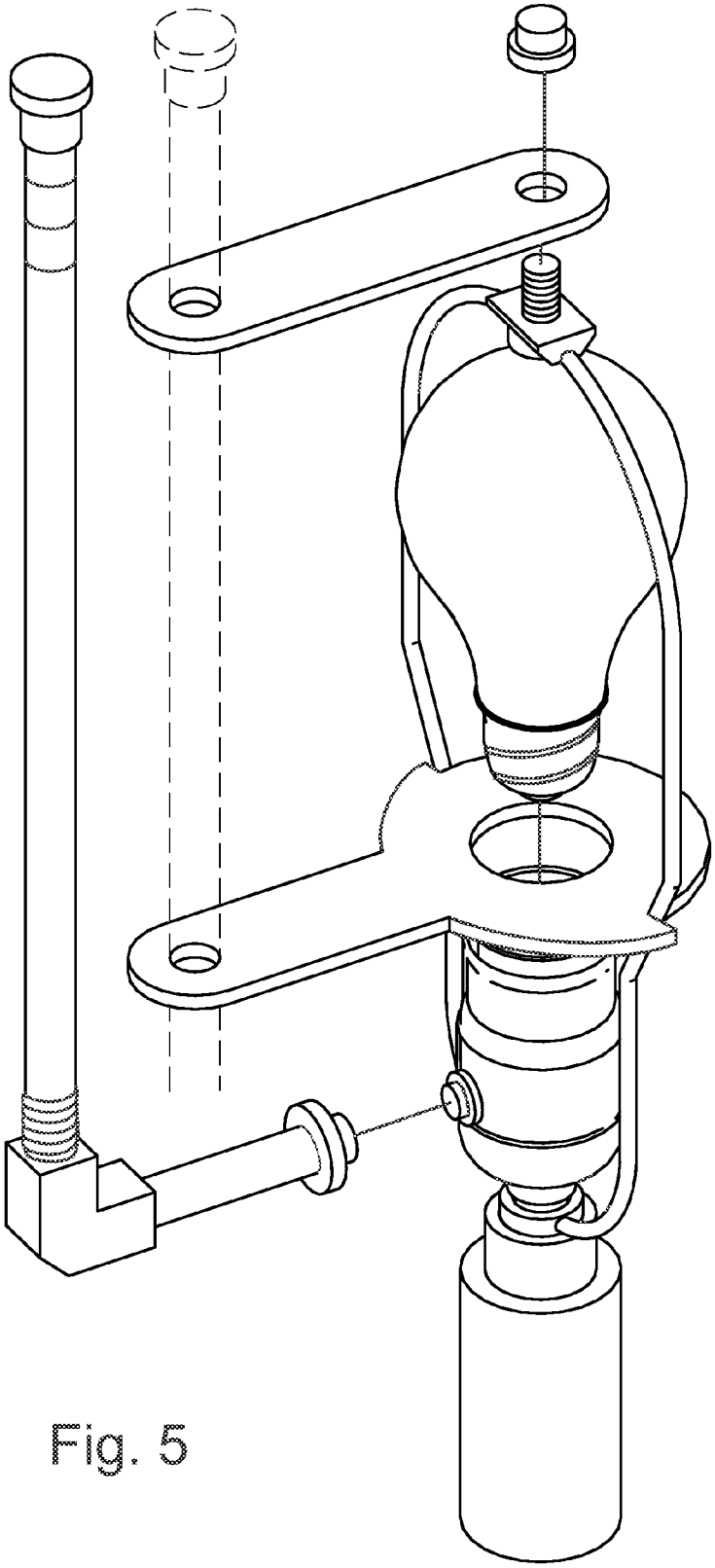
FIG. 5 is an exploded perspective view of the apparatus embodiment that works with a twist on and off switch for the lamp.
Figure 6:
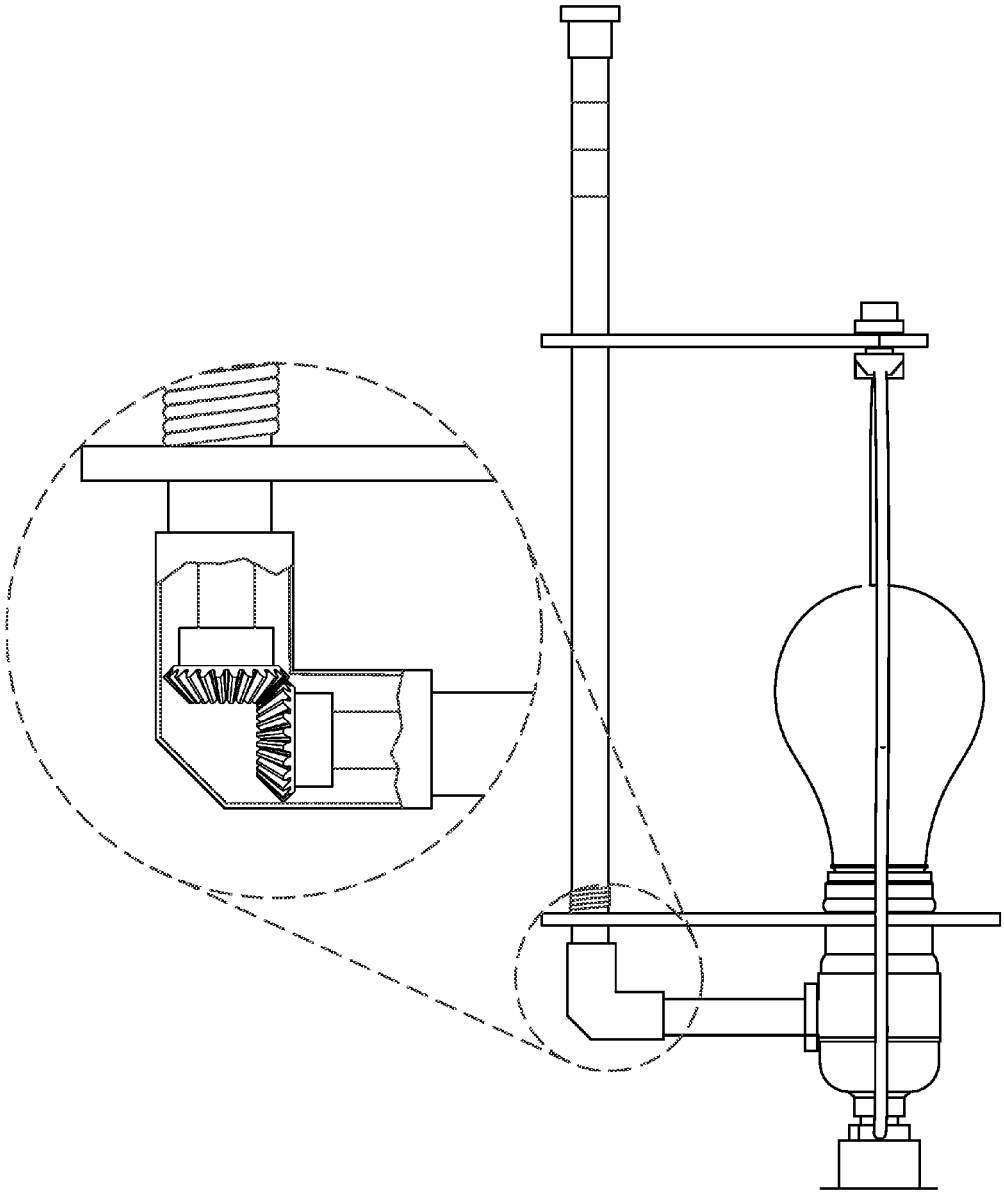
FIG. 6 is an exploded, cut-away view of the 90 degree beveled gearbox that connects the vertical portion of the extension switch to the horizontal portion of the extension switch.
Figure 7:
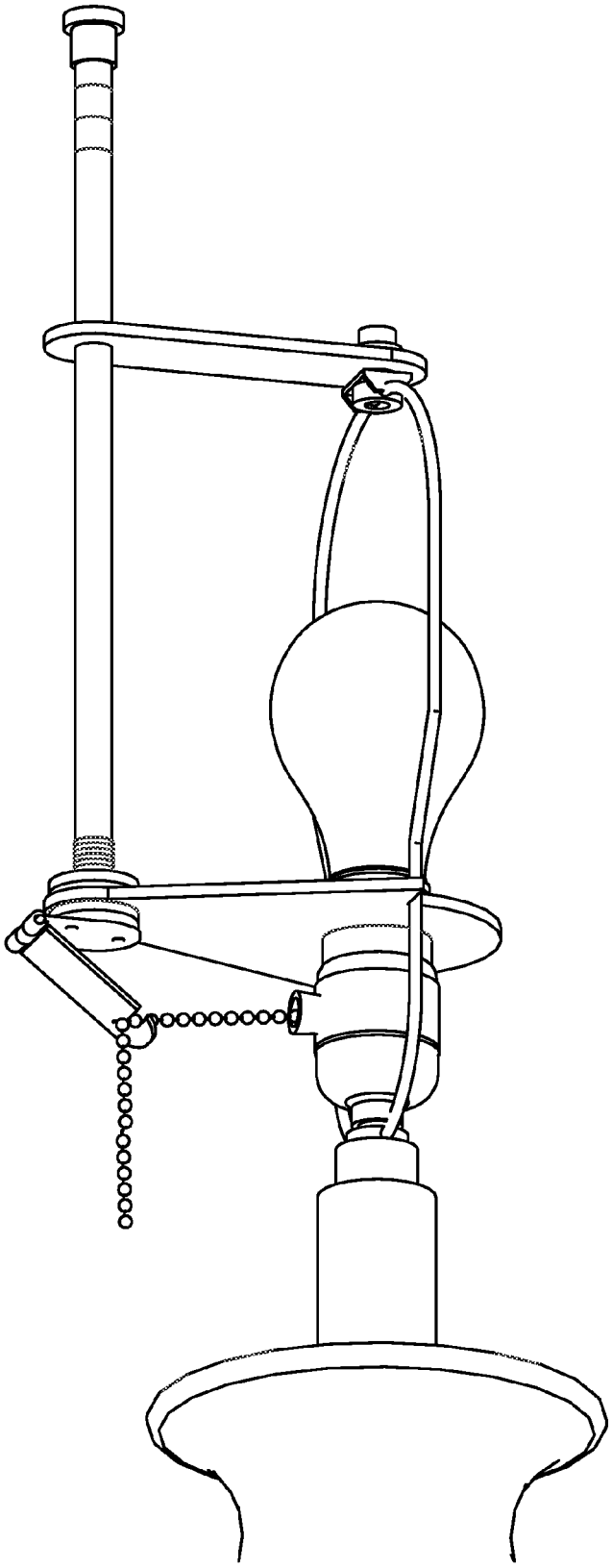
FIG. 7 is a perspective view of an embodiment of the apparatus that will work with pull-chain type on and off switches.
Figure 8:
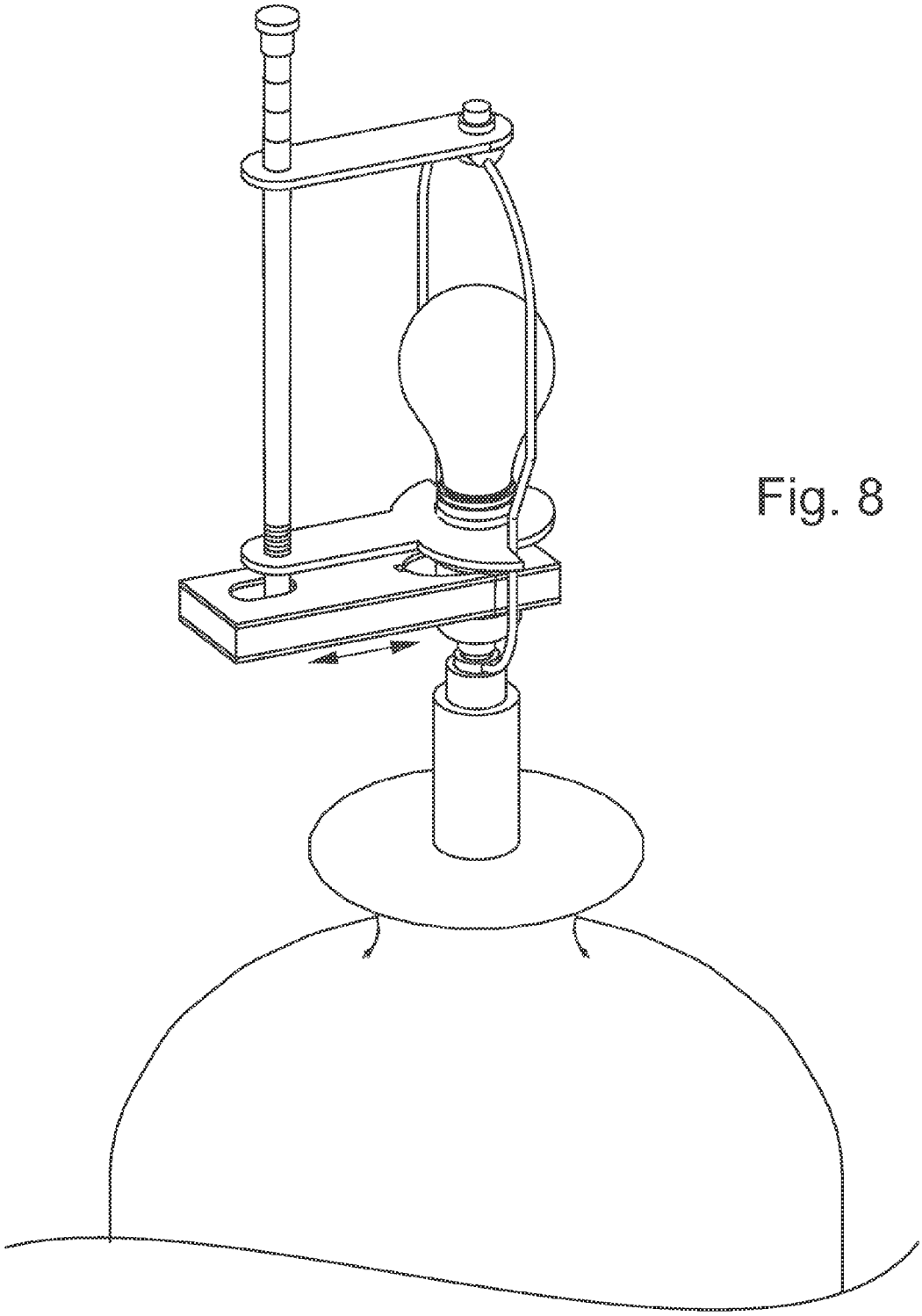
FIG. 8 is a perspective view of an embodiment of the apparatus that will work with the push through type on and off switch for lamps.
Figure 9:
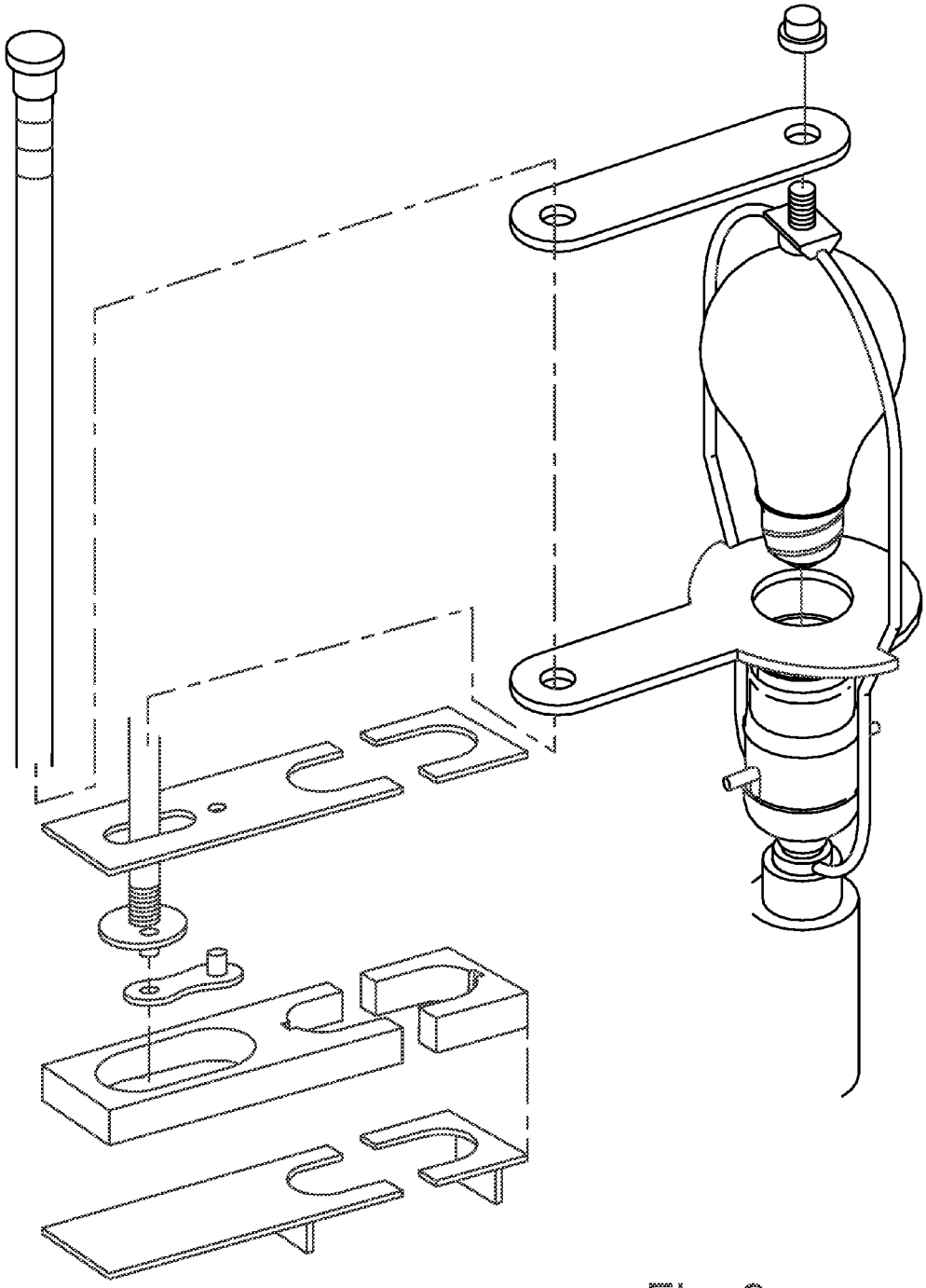
FIG. 9 is an exploded view of the embodiment of the apparatus that will work with the push through type of on and off switch for lamps.

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

The preferred embodiment of the present invention generally contemplates an apparatus that improves the usefulness of the rotatable on and off switch for the common household lamp. The apparatus comprises a turning mechanism with a knob at the top that is located at or near the top of a typical lamp shade for the lamp. The knob controls a twistable extension that is generally in the vertical position next to the typical light bulb for the lamp and the typical harp mechanism that supports the lamp shade. In the preferred embodiment, this vertical extension member is a thick metal wire or thin metal rod to withstand the heat from the light bulb, but in alternative embodiments when heat can be reduced as a factor either by positioning or type of bulb, this vertical member could be a thin piece of plastic or other rigid material. The apparatus is typically positioned inside the lamp shade where the on and off switch is typically positioned. The vertical member is fixedly connected in-line to a plastic conical member that mates with the typically shorter horizontal member through an elbow joint that contains a 90 degree beveled gearbox drive mechanism. The end of the horizontal member opposite the gearbox mechanism has a knob with a threaded hole in-line in the center of the knob to receive the standard metal shaft that remains after removing the standard on and off knob that comes with a standard lamp. Thus turning the top knob that is reached at the top of the lamp shade turns the vertical member that mates with and turns the horizontal member that is attached to the typical on and off turning knob of the lamp upon installation. The height of the top knob in relationship to the top of the lamp shade may be adjusted by using vertical members or top knobs of various lengths.

The apparatus is braced to the lamp at two points using simple planar material. The top brace has multiple small holes in it for adjustability. The vertical shaft goes through one and one of the other holes is used to attach the brace to the top of the harp along with the typical lamp shade. The lower brace is similarly planar with a hole for the lower portion of the vertical shaft and then at the other side it has a larger hole to be fitted over a standard socket receptacle for the light bulb used in the lamp. This lower brace also has short extensions or wings on either side of the larger hole to brace against the lower portions of the standard lamp harp stays.

In one alternative embodiment of the apparatus for use with lamps that have some variation of the standard on and off pull chain switch, the lower horizontal member and the gearbox are replaced by a planar material that attaches by a hinge to a round planar member attached to the bottom of the vertical member. The hinged planar piece has a notch configured to catch and put the chain switch when the top knob at the top of the vertical member is twisted.

In another alternative embodiment, the horizontal member is by a device that is designed to convert the twist of the top knob and vertical member into a horizontal back and forth movement to work with the standard push through on and off switch mechanism for a lamp. In this embodiment, the vertical member is attached to an oval planar piece housed in a space in the device. In the current form the space in the device is located between an upper and lower planar surface, but in a more preferred embodiment of this alternative embodiment of the overall apparatus the device will not be constructed between the two planar surfaces and instead will be molded as two pieces (left and right sides) that snap together around the standard lamp light socket. The oval piece that is attached to the vertical member has an offset hole for attaching a connector that is constrained to move back and forth in the space as the knob at the top of the vertical extender member is twisted. The other end of the connector is attached to the device that houses the oval planar piece and the connector. The vertical member (that is connected on the top end to a knob at or near the top of the lamp shade and on the bottom end to the oval planar piece) is constrained to only be able to turn within the holes of the two planar members that brace it to the lamp socket and the top of the lamp harp and to not be able to move in or out in relationship to the lamp. When twisted, the vertical member makes the housing device move back and forth toward and away from the lamp. This back and forth operation moves the push through on and off switch such that the switch is pushed in from one side as the device moves toward the lamp and then the push through on and off switch is pushed back from the other side as the knob continues to be twisted and the device moves away from the lamp. The ends of the push through on and off switch fit into shallow holes on either side of the oval that is created by connecting the two sides of the device and that is designed to slide back and forth around the lamp socket.

The vertical member and the top knob are available in different lengths to fit different sizes of lampshades. The vertical member does not interfere with tilting of a lampshade, and it does not have to be removed to replace a light bulb. The installed apparatus does not prevent the user from still turning the lamp on and off from its original knob location.

What is claimed is:

1. An apparatus for improved access to a household lamp on and off switch, said apparatus comprising a vertical member attached to a horizontal member that attaches to a standard rotatable on and off switch of the common household lamp, said vertical member presenting an end located at or near the top of the typical lamp shade for the lamp.

2. The apparatus of claim 1 wherein said vertical member and said horizontal member are turning mechanisms that are operably connected through a joint mechanism.

3. The apparatus of claim 2 wherein said vertical member has a knob attached at the top end and the bottom end is attached to the joint mechanism.

4. The apparatus of claim 3 wherein said horizontal member is attached to the joint mechanism on the end distant from the lamp and is attached to the rotatable on and off switch at the end proximate to the lamp.

5. The apparatus of claim 4 wherein said joint mechanism is a beveled gearbox drive mechanism where rotation of the vertical member causes rotation of the horizontal member and the rotation of the horizontal member causes the rotation on and off turning knob of the lamp switch.

6. The apparatus of claim 5 wherein said vertical member is braced to the lamp by at least one piece of bracing material, one end of which has at least one hole that the vertical member can pass through and the other end of which has at least one hole that can accept a part of the lamp.

7. The apparatus of claim 6 wherein said bracing material is planar in shape and where two pieces are used the top piece will attach to the top of the typical harp that supports a typical lamp shade and the lower piece will have a larger hole that enables it to fit over a typical socket receptacle for the light bulb and braces on either side to hold the harp in a plane that is approximately perpendicular to the direction of the horizontal member.

8. An apparatus for improved access to a household lamp on and off switch, said apparatus comprising a vertical member attached to an element that can grab a standard pull chain on and off switch of the common household lamp, said vertical member presenting an end located at or near the top of the typical lamp shade for the lamp.

9. The apparatus in claim 8 wherein the element attached to the bottom of the vertical member is at least one disc element with a planar element attached by a hinge to said disc element and said planar element has a notch toward the end opposite the hinge that can grab the standard pull on and off chain, but the standard pull on and off chain can still be used as originally designed.

10. An apparatus for improved access to a household lamp on and off push through switch, said apparatus comprising a vertical member attached to a multi-part element that can push a standard push through on and off switch of the common household lamp from either direction, said vertical member presenting an end located at or near the top of the typical lamp shade for the lamp.

11. The apparatus in claim 10 wherein the element attached to the bottom of the vertical member comprises a rotatable disc attached to the bottom of the vertical member; said disc being encased in a space inside a flat box-like structure and having an offset connection to a component that further attaches to the inside of the structure in such a constrain way that as the top knob of the vertical element is twisted the off-set disc connection to the structure causes the structure to move back and forth in-line with the push through on and off switch.

12. The apparatus in claim 11 wherein the structure slides back and forth around the standard lamp light socket by means of a vertically oriented oblong hole through the structure and wherein the structure will come in at least 2 pieces so that the two sides can be connected around the light socket thus forming the hole.

13. The apparatus of claim 12 wherein the oblong hole that moves back and forth around the light socket has a notch disposed at either end where the ends of the push through on and off switch for the lamp are to be positioned when the structure is connected around the light socket portion of the lamp.

14. The apparatus of claim 13 wherein the structure has two elements protruding from the bottom side that are positioned so that a user can manually apply pressure from either side to the structure to manually operate the push through on and off switch of the lamp at the socket.

* * * * *